US006425249B1

(12) United States Patent
Cho et al.

(10) Patent No.: US 6,425,249 B1
(45) **Date of Patent: *Jul. 30, 2002**

(54) HIGH EFFICIENCY REFRIGERATION SYSTEM

(75) Inventors: Young I. Cho, Cherry Hill, NJ (US); Cheolho Bai, Taegu (KR)

(73) Assignee: VAI Holdings, LLC, Cherry Hill, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,126

(22) Filed: Mar. 24, 2000

Related U.S. Application Data

(63) Continuation-in-part of application No. 09/517,922, filed on Mar. 3, 2000.

(51) Int. Cl.[7] ..... F25B 9/02; F25B 13/00; F25B 1/00

(52) U.S. Cl. ..... 62/5; 62/324.6; 62/498

(58) Field of Search ..... 62/5, 324.6, 498, 62/467

(56) References Cited

U.S. PATENT DOCUMENTS

| | | | | |
|---|---|---|---|---|
| 2,920,457 A | * | 1/1960 | Bartlett | 62/5 |
| 3,287,924 A | * | 11/1966 | Bright | 62/5 |
| 3,775,988 A | | 12/1973 | Fekete | 62/23 |
| 3,902,876 A | | 9/1975 | Moen et al. | 55/348 |
| 4,026,120 A | | 5/1977 | Tallant | 62/5 |
| 4,290,791 A | | 9/1981 | Matsui et al. | 55/399 |
| 4,302,949 A | | 12/1981 | Longhetto | 62/402 |
| 4,531,371 A | | 7/1985 | Voronin et al. | 62/5 |
| 4,646,524 A | * | 3/1987 | Kawashima et al. | 62/5 |
| 5,704,219 A | | 1/1998 | Suzuki et al. | 62/222 |
| 5,976,227 A | | 11/1999 | Lorey | 96/209 |
| 5,996,360 A | | 12/1999 | Tanaka et al. | 62/160 |
| 6,006,541 A | | 12/1999 | Taylor | 62/453 |
| 6,006,544 A | | 12/1999 | Watanabe et al. | 62/511 |
| 6,250,086 B1 | * | 6/2001 | Cho et al. | 62/5 |

FOREIGN PATENT DOCUMENTS

| | | |
|---|---|---|
| JP | 5126426 A | 5/1993 |
| JP | 8303879 A | 11/1996 |
| JP | 8313072 A | 11/1996 |
| JP | 8313096 A | 11/1996 |
| JP | 8320157 A | 12/1996 |
| JP | 10141792 A | 5/1998 |
| JP | 11193968 A | 7/1999 |

OTHER PUBLICATIONS

Brochure from Newman Tools, Inc.
Brochure from Air Research Technology Company.
Brochure from Filtan Inc.

* cited by examiner

*Primary Examiner*—William C. Doerrler
(74) *Attorney, Agent, or Firm*—Mark A. Garzia, P.C.

(57) ABSTRACT

An improved refrigeration system utilizing one or more vortex tubes. Vortex tubes produce liquid refrigerant from saturated-state vapor refrigerant in a vapor-compression refrigeration cycle. The efficiency of a refrigeration system can be improved by placing vortex tubes before and after the evaporator.

12 Claims, 12 Drawing Sheets

HIGH EFFICIENCY REFRIGERATION SYSTEM

CROSS REFERENCE TO RELATED APPLICATION

This application is a continuation-in-part of U.S. application Ser. No. 09/517,922 filed Mar. 3, 2000.

FIELD OF THE INVENTION

The present invention relates generally to a high efficiency refrigeration system and, more specifically, to a refrigeration system utilizing one or more vortex tubes for increasing the overall efficiency of a refrigeration system.

BACKGROUND OF THE INVENTION

A refrigeration system typically consists of four major components connected together via a conduit (preferably copper tubing) to form a closed loop system. The four major components are a compressor, a condenser, an expansion device and an evaporator. A refrigerant will have its pressure either increased or decreased and its temperature either increased or decreased by the four components as it circulates therethrough.

The refrigerant is continuously cycled through the refrigeration system. The main steps in the refrigeration cycle are compression of the refrigerant by the compressor, heat rejection of the refrigerant in the condenser, throttling of the refrigerant in the expansion device, and heat absorption of the refrigerant in the evaporator. The compressor provides the energy to keep the refrigerant moving within the conduits and through the major components This process is sometimes referred to as a vapor-compression refrigeration cycle.

The vapor-compression refrigeration cycle is used in air conditioning systems, which cool and dehumidify air in a living space, in a moving vehicle (e.g., automobile, airplane, train, etc.), refrigerators and heat pumps.

During the refrigeration cycle, the refrigerant enters the compressor as saturated vapor and is compressed to a very high pressure. The temperature of the refrigerant increases during this compression step. The refrigerant leaves the compressor as superheated vapor and enters the condenser. A typical condenser comprises a single conduit formed into a serpentine-like shape so that a plurality of rows of conduit is formed parallel to each other. Metal fins or other aids are usually attached to the serpentine conduit in order to increase the transfer of heat between the refrigerant passing through the condenser and the ambient air. Heat is rejected from the superheated vapor as it passes through the condenser and the refrigerant exits the condenser as saturated liquid.

The expansion device reduces the pressure of the saturated liquid thereby turning it into a saturated liquid-vapor mixture, which is throttled to the evaporator. The temperature of the refrigerant drops below the temperature of the ambient air as it goes through the expansion device. The refrigerant enters the evaporator as a low quality saturated mixture comprised of approximately 20% vapor and 80% liquid. ("Quality" is defined as the mass fraction of vapor in the liquid-vapor mixture.)

The evaporator physically resembles the serpentine-shaped conduit of the condenser. Ideally, the refrigerant completely evaporates by absorbing heat from the refrigerated space and leaves the evaporator as saturated vapor at the suction pressure of the compressor and reenters the compressor thereby completing the cycle.

The efficiency of a refrigeration cycle is traditionally described by an energy-efficiency ratio (EER). It is defined as the ratio of the heat absorption from an evaporator to the work done by a compressor.

$$\text{EER} = \frac{\text{Heat absorption from evaporator}}{\text{Work done by compressor}}$$

In a typical air conditioning system, the refrigeration cycle has an EER of approximately 2.0 (kw/kw).

SUMMARY OF THE INVENTION

The present invention is designed to increase the efficiency of a refrigeration, air conditioning or heat pump system by increasing the efficiency of the refrigeration cycle. The increase in the efficiency is achieved by assisting in the conversion of the refrigerant from vapor to liquid at specific points in the refrigeration cycle. In a preferred embodiment of the present invention, a first vortex tube is placed between the expansion device and the evaporator in order to increase the percentage of refrigerant entering the evaporator as a liquid, and a second vortex tube is placed between the evaporator and the compressor in order to increase the percentage of refrigerant entering the compressor as a vapor. Since the heat absorption from the evaporator occurs through the evaporation of the liquid refrigerant, the increase in the percentage of the liquid refrigerant entering the evaporator increases the efficiency of the refrigeration cycle and reduces the size of the evaporator.

Another way the present invention increases the efficiency of the refrigeration cycle is by placing a vortex tube in the serpentine tubing of the condenser. In the preferred embodiment, the vortex tube is placed approximately one-quarter of the way in from the inlet of the condenser where desuperheating is completed. Once again, the vortex tube produces liquid refrigerant and further increases the temperature of the vapor refrigerant thereby reducing the size of the condenser and decreasing the head pressure of the compressor. As a result, the compression ratio decreases, and the work required by the compressor is reduced, thus increasing the efficiency of the refrigeration cycle.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENT

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Preferred embodiments of the present invention will now be described in detail with reference to the accompanying drawings in which a refrigeration system in accordance with the present invention is generally indicated at 10.

Figure 1:
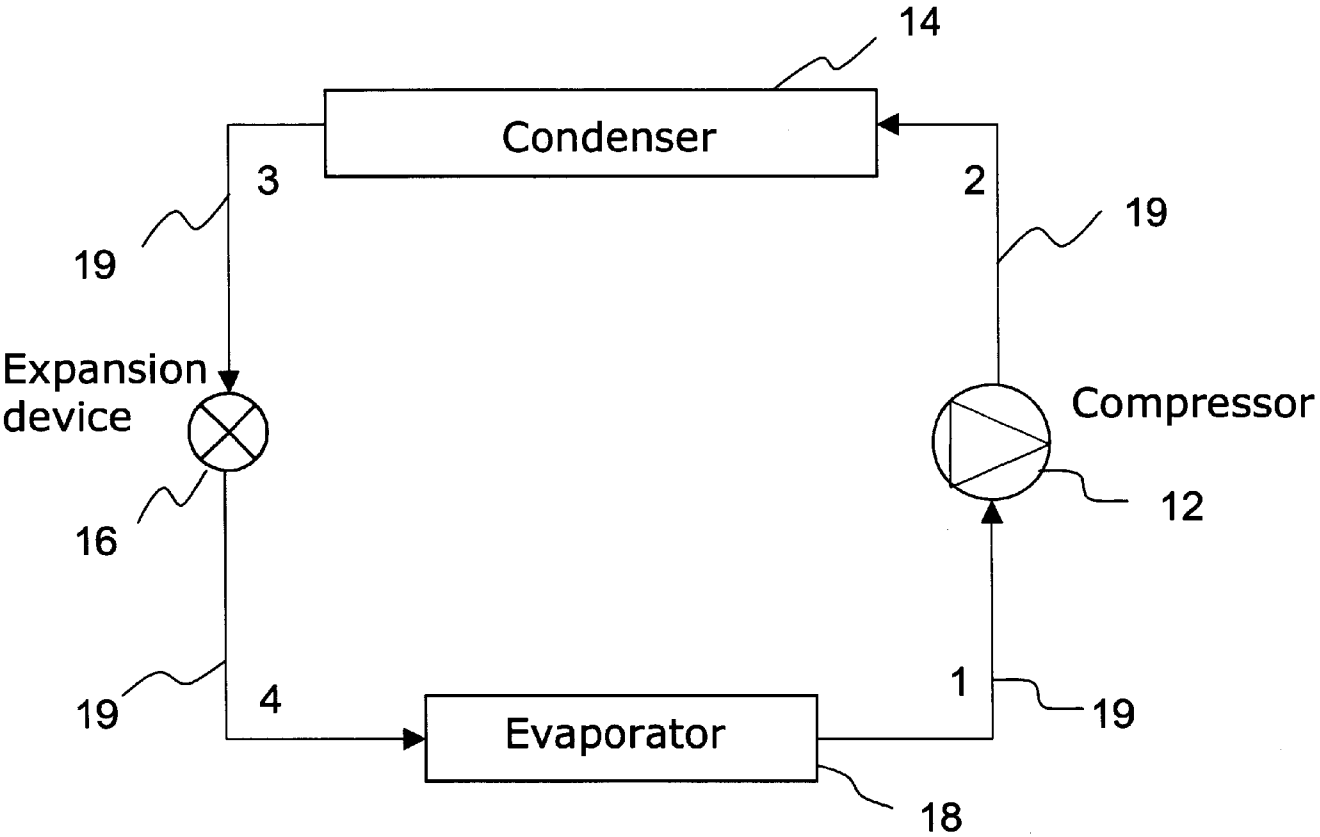
Fig. 1 PRIOR ART
FIG. 1 is a block diagram of a typical refrigeration system.

A typical refrigeration system is illustrated in FIG. 1. The refrigeration system includes a compressor 12, a condenser 14, an expansion device 16 and an evaporator 18. The various components are connected together via copper tubing 19.

The refrigeration system is a closed loop system that circulates a refrigerant through the various elements. Some common types of refrigerant include R-12, R-22, R-134A, R-410A, ammonia, carbon dioxide and natural gas. A refrigerant is continuously cycled through the refrigeration system. The main steps in the refrigeration cycle are compression of the refrigerant by the compressor, heat rejection of the refrigerant in the condenser, throttling of the refrigerant in the expansion device, and heat absorption of the refrigerant in the evaporator. As indicated previously, this process is referred to as the vapor compression refrigeration cycle.

Figure 2:
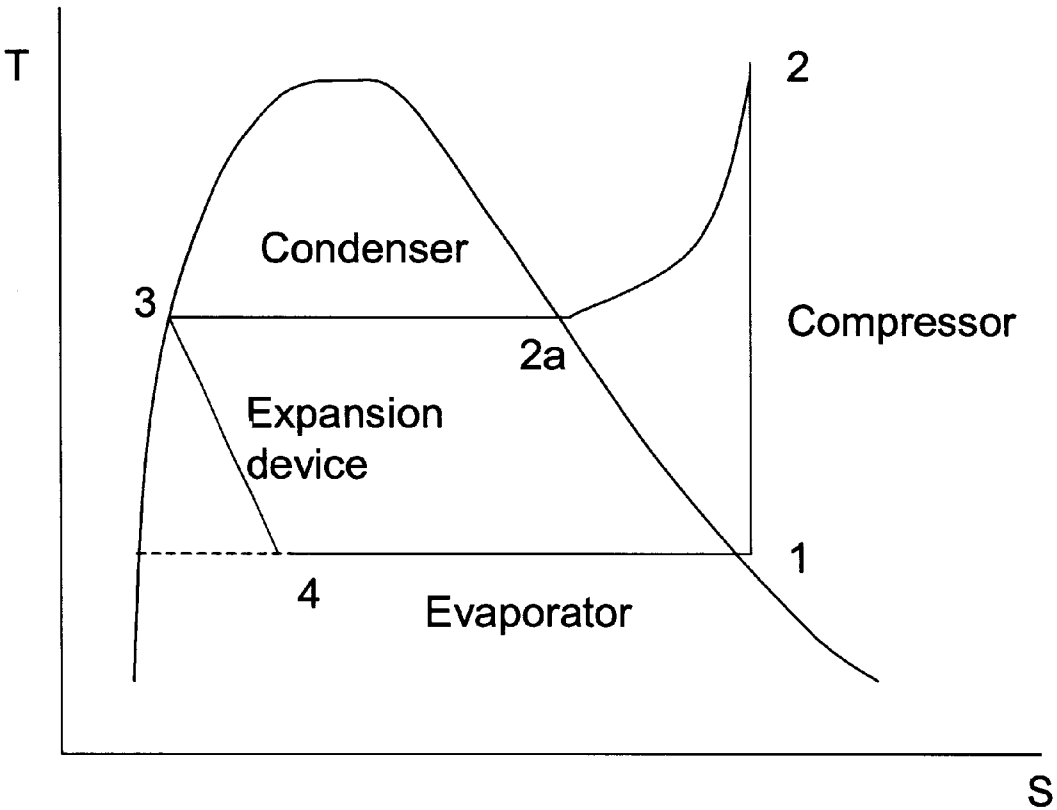
Fig. 2 PRIOR ART
FIG. 2 shows a temperature entropy diagram of the refrigeration system illustrated in FIG. 1.

The temperature entropy curve of a typical refrigeration cycle is illustrated is FIG. 2. Point 2 is where the refrigerant exists as a superheated vapor. As the superheated vapor cools inside the condenser, the superheated vapor becomes a saturated vapor (point 2*a*). As heat transfer to the ambient air continues in the condenser, the refrigerant becomes a saturated liquid at point 3. After going through the expansion device, the refrigerant becomes a mixture of approximately 20% vapor and 80% liquid at point 4. As the refrigerant absorbs heat in the evaporator, the refrigerant becomes a saturated vapor at the suction pressure at point 1.

The efficiency of a refrigeration cycle (and by analogy a heat pump cycle) depends primarily on the heat absorption from the evaporator and the efficiency of the compressor. The former depends on the percentage of liquid in the liquid-vapor refrigerant mixture before the evaporator, whereas the latter depends on the magnitude of the head or discharge pressure. The pressure of the refrigerant as it enters the compressor is referred to as the suction pressure level and the pressure of the refrigerant as it leaves the compressor is referred to as the head pressure level. Depending on the type of refrigerant used, the head pressure can range from about 170 PSIG to about 450 PSIG.

Compression ratio is the term used to express the pressure difference between the head pressure and the suction pressure. Compression ratio is calculated by converting the head pressure and the suction pressure onto an absolute pressure scale and dividing the head pressure by the suction pressure. When the compression ratio increases, the compressor efficiency drops thereby increasing energy consumption. (In most cases, the energy is used by the electric motor that drives the compressor.) In addition, the temperature of the refrigerant vapor increases to the point that oil for lubrication may be overheated which may cause corrosion in the refrigeration system.

When a compressor runs at a high compression ratio, it no longer has the capability to keep a refrigerated space or living space at the designated temperature. As the compressor efficiency drops, more electricity is used for less refrigeration. Furthermore, running the compressor at a high compression ratio increases the wear and tear on the compressor and decreases its operating life.

An evaporator is made of a long coil or a series of heat transfer panels which absorb heat from a volume of air that is desired to be cooled. In order to absorb heat from this ambient volume, the temperature of the refrigerant must be lower than that of the volume. The refrigerant exiting the expansion device consists of low quality vapor, which is approximately 20% vapor and 80% liquid.

The liquid portion of the refrigerant is used to absorb heat from the desired volume as the liquid refrigerant evaporates inside the evaporator. The vapor portion of the refrigerant is not utilized to absorb heat from the ambient volume. In other words, the vapor portion of the refrigerant does not contribute to cooling the ambient volume and decreases the efficiency of the refrigeration cycle.

Figure 3:
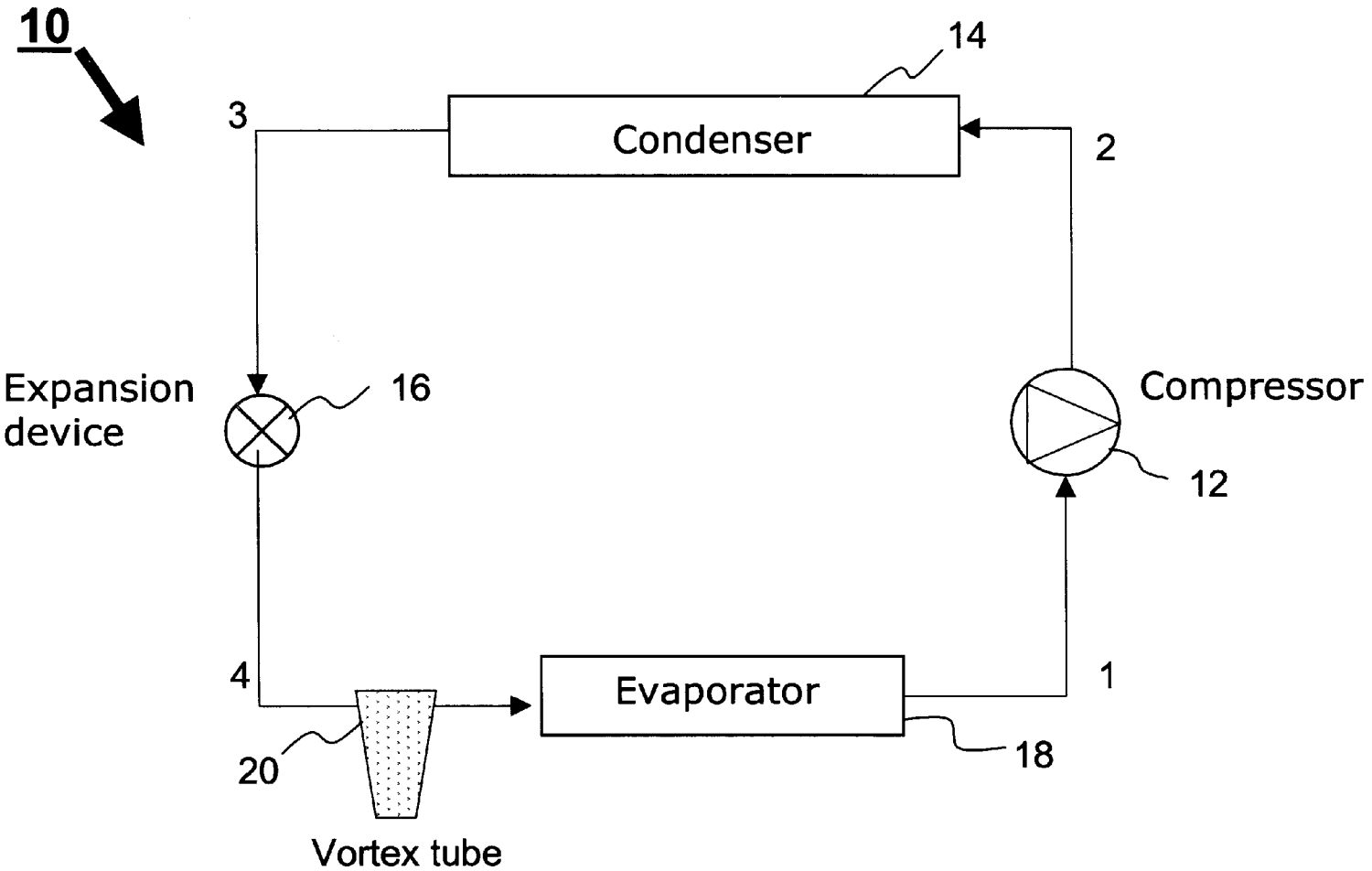
FIG. 3 is a block diagram of a refrigeration system in accordance with the present invention utilizing a vortex tube proximate the evaporator.

Referring to FIG. 3, the present invention uses a vortex tube 20 between the expansion device 16 and the evaporator 18. Vortex tube 20 converts at least a portion of the refrigerant vapor that exits the expansion device into liquid so that it can be used in the evaporator to absorb heat from the ambient volume. Vortex tubes are well-known in other areas of art but are not commonly found in refrigeration systems.

Figures 4A, 4B:
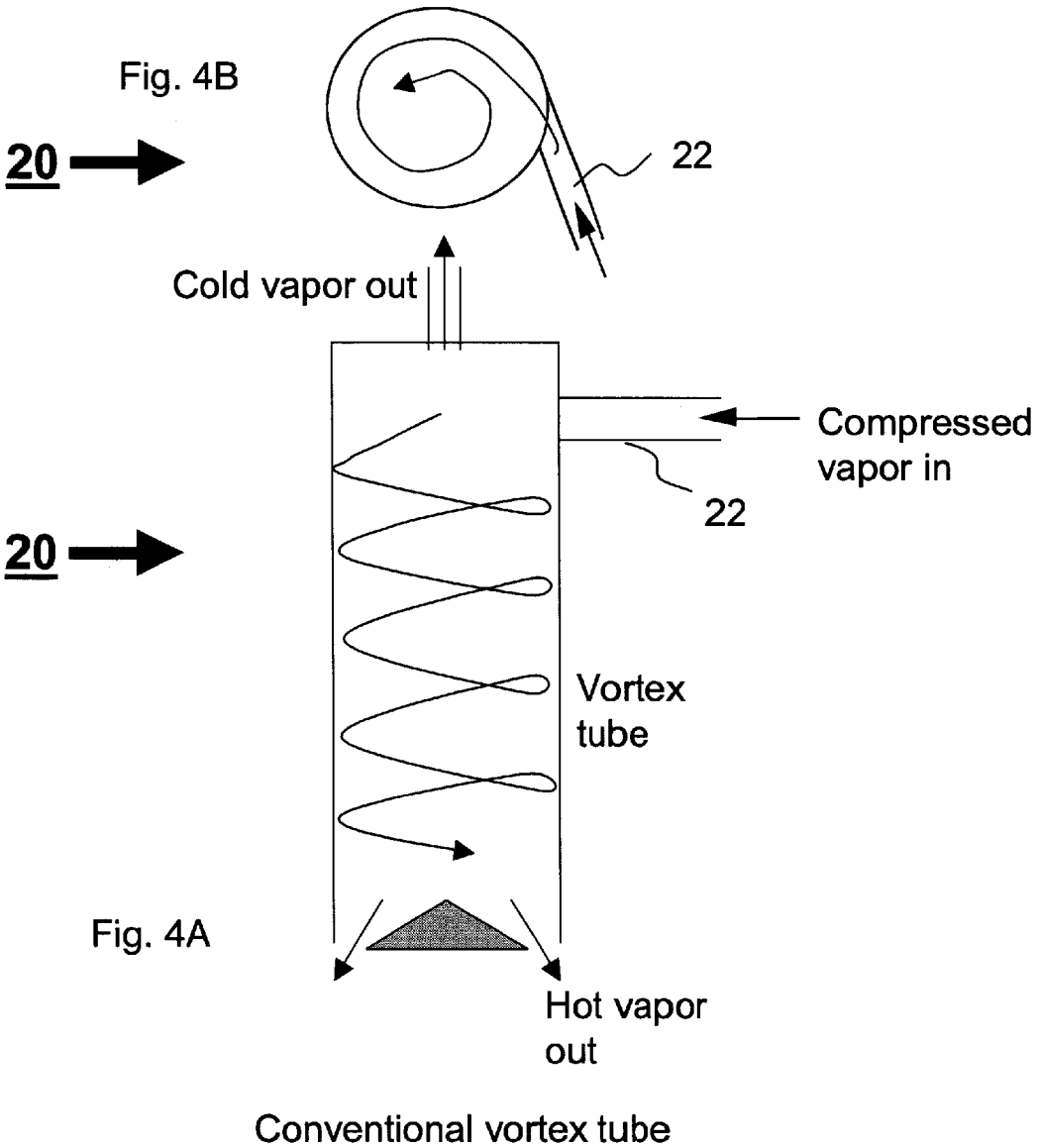
FIG. 4A illustrates a side cut-away view of a conventional vortex tube.
FIG. 4B is a top cut-away view of the vortex tube shown in FIG. 4A.

As illustrated in FIG. 4A, the vortex tube 20 is a device which converts a flow of compressed gas into two streams—one stream hotter than and the other stream colder than the temperature of the gas supplied to the vortex tube. A vortex tube does not contain any moving parts.

Referring now to FIG. 4B, a high pressure gas stream is shown entering the vortex tube 20 tangentially at one end (i.e., the inlet 22). The high pressure gas stream produces a strong vortex flow in the tube 20. The vortex flow is similar in shape to a helix. The high pressure gas separates into two streams having different temperatures, one along the outer wall and one along the axis of the tube. In the outer stream, the circumferential velocity is inversely proportional to the radial position. The pressure within a vortex tube is lowest at the center of the tube and increases to a maximum at the wall.

The high pressure gas that enters a vortex tube will be the refrigerant in a refrigeration cycle. Since vapor refrigerant is a compressible medium, the pressure distribution within the vortex tube causes a temperature difference between the inner and outer streams.

Referring again to FIG. 3, in the preferred embodiment, the vortex tube 20 is preferably placed proximate the evaporator 18. In order to reduce manufacturing costs, the vortex tube 20 may be placed immediately before the evaporator 18. However, other positions of the vortex tube proximate the evaporator including a percentage of the distance from the inlet of the evaporator may be desirable.

A condenser 14 in the refrigeration cycle is used to convert superheated refrigerant vapor to liquid by rejecting heat to the surroundings. The condenser is a long heat transfer coil or series of heat rejecting panels similar in appearance to the evaporator. Referring again to FIG. 1, as refrigerant enters the condenser 14, the superheated vapor first becomes saturated vapor in the approximately first quarter-section of the condenser, and the saturated vapor undergoes phase change in the remainder of the condenser at approximately constant pressure.

Since the heat rejection from the condenser to the surroundings can occur only when the temperature of the refrigerant is greater than that of the surroundings, the refrigerant temperature has to be raised well above that of the surroundings. This is accomplished by raising the pressure of the refrigerant vapor, a task that is done by the compressor 12. Since vapor temperature is closely related to vapor pressure, it is critically important that the condenser efficiently rejects heat from the refrigerant to the surroundings. If the condenser 14 is not efficient, the compressor 12 has to further increase the head pressure in an attempt to assist the condenser in dumping heat to the surroundings.

Figure 5:
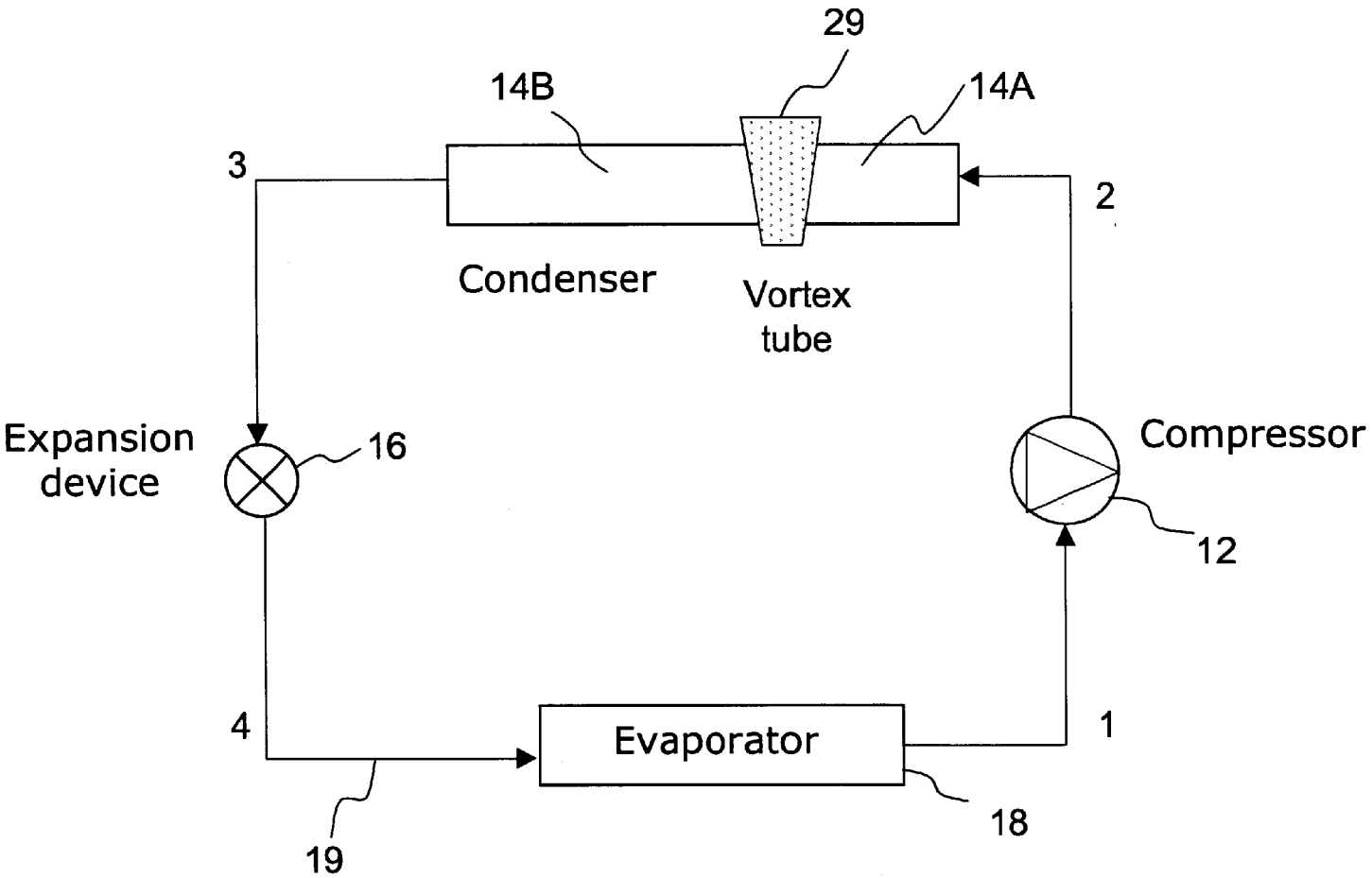
FIG. 5 is a block diagram of a refrigeration system in accordance with the present invention utilizing a vortex tube in the condenser.

As illustrated in FIG. 5, another embodiment of the present invention utilizes a vortex tube 29 in the condenser to convert saturated refrigerant vapor to liquid thus increasing the condenser's efficiency. The first approximately one-quarter of the condenser is represented by 14A and the remaining three-quarters of the condenser is represented by 14B.

Figure 6:
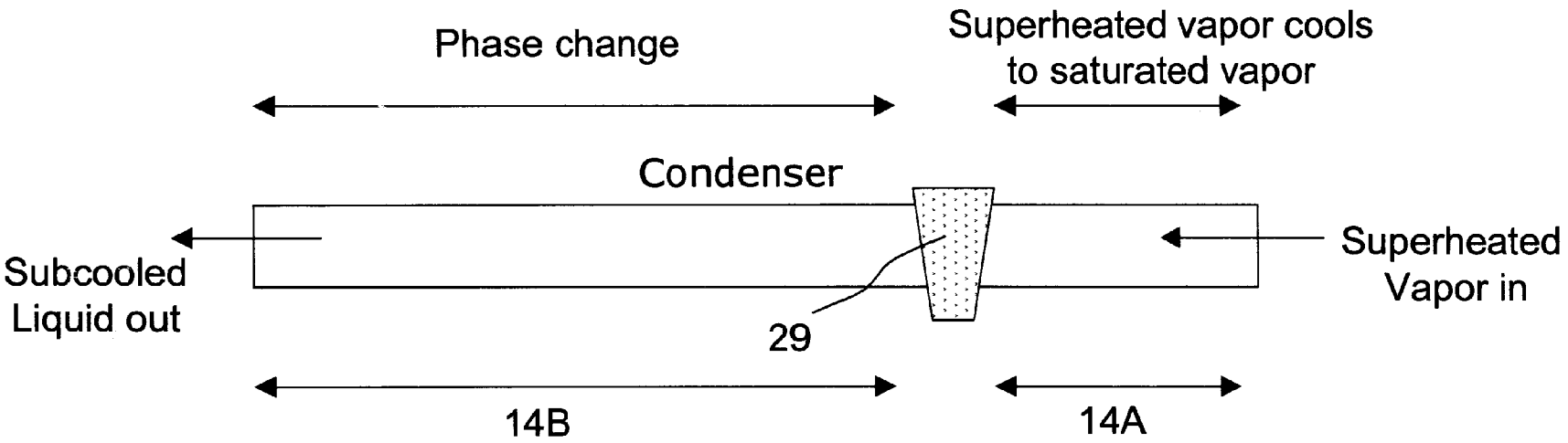
FIG. 6 is a pictorial representation of the phase change in the refrigerant in a condenser and vortex tube of the type used in the refrigeration system of FIG. 5.

Referring to FIG. 6, in the preferred embodiment the vortex tube 29 is inserted approximately one-quarter of the way into the condenser (i.e., at the point where the superheated vapor becomes saturated vapor in full or in part). By inserting the vortex tube 29 in an existing condenser, manufacturing costs may be minimized. However, for all intents and purposes two separate condensers, each about the respective size of condenser portions 14A and 14B, may be used.

When a vortex tube 29 is placed approximately one-fourth of the way from the inlet of the condenser, the temperature of the refrigerant does not have to be raised well over that of the surroundings thus allowing the compressor to run at a lower head pressure than would be the case without the vortex tube 29.

Since the refrigerant vapor becomes saturated liquid at the output of the condenser, the size of the condenser in prior art refrigeration systems is often chosen larger than necessary in order to ensure the exchange of heat. The present method allows the size of the condenser 14 to be reduced because the substantial amount of saturated refrigerant vapor is converted to liquid by the vortex tube. The present invention allows the use of a smaller condenser than is the case without a vortex tube thereby reducing the size of air conditioning systems, refrigerators and heat pumps.

Figure 7:
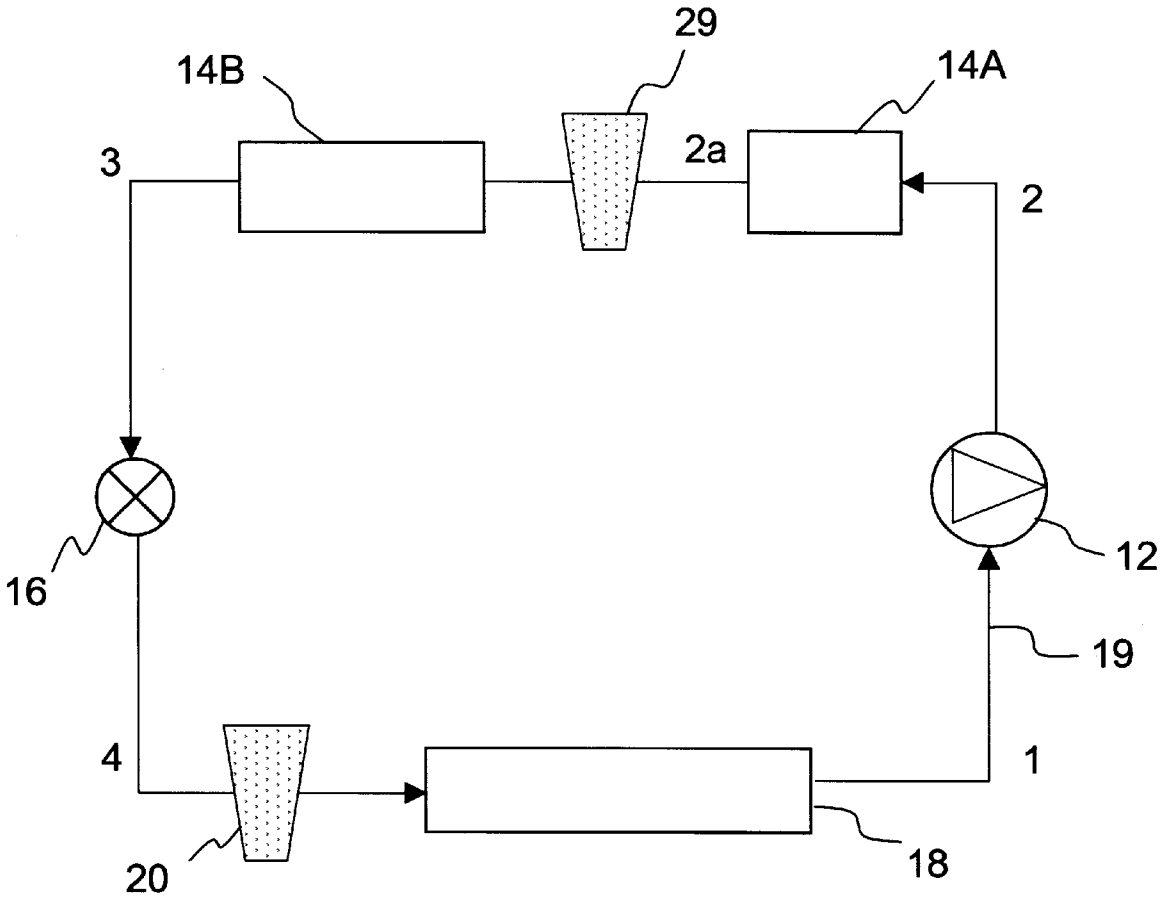
FIG. 7 is a block diagram of another embodiment of refrigeration system in accordance with the present invention which utilizes two vortex tubes.

A further embodiment of the present invention utilizes two vortex tubes, one before the evaporator and the second in the condenser, as illustrated in FIG. 7.

The vortex tubes operate in a similar fashion as described in a refrigeration system when only one vortex tube is used. However, the efficiency of the refrigeration system illustrated in FIG. 7 is greater than the efficiency of the refrigeration illustrated in either FIG. 3 or FIG. 5.

Figure 8:
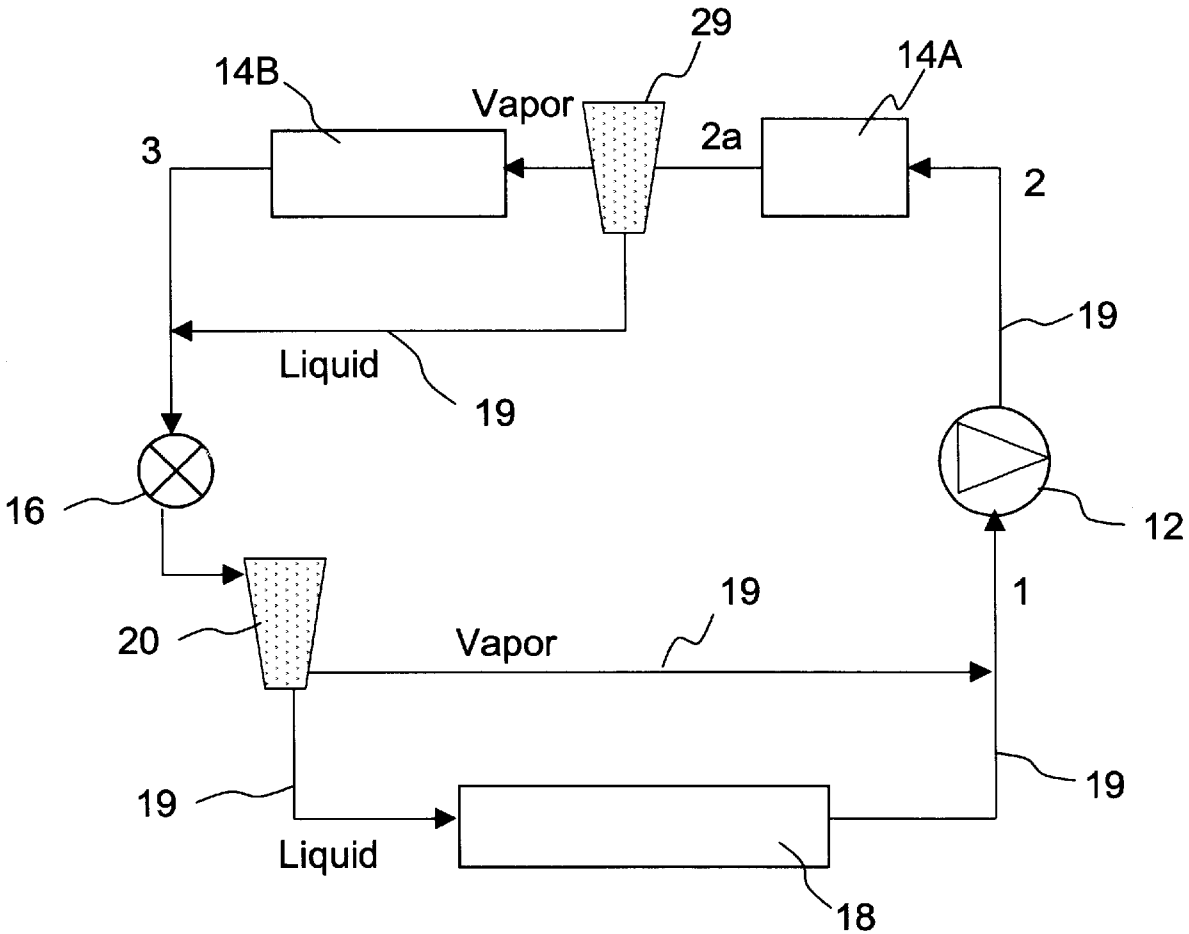
FIG. 8 is a block diagram of the refrigeration system of FIG. 7 in which the refrigerant vapor bypasses the evaporator and the liquid refrigerant bypasses the condenser.

FIG. 8 illustrates a variation of the two vortex tube refrigeration systems illustrated in FIG. 7. Instead of the vapor that exits vortex tube 20 being recombined with the liquid before entering the evaporator 18, a separate path for the vapor, bypassing the evaporator, is shown. This variation should be slightly more efficient than recombining the liquid with the vapor because the vapor does not absorb any heat as it passes through the evaporator. Accordingly, only liquid refrigerant enters evaporator 18.

Referring again to FIG. 8, the liquid portion of the refrigerant is drawn off from vortex tube 29 and bypasses condenser 14B. In this manner, the heat in the vapor refrigerant is rejected by condenser 14B. Since there is very little heat stored in the refrigerant liquid, it does not need to be passed through condenser 14B.

Figure 9:
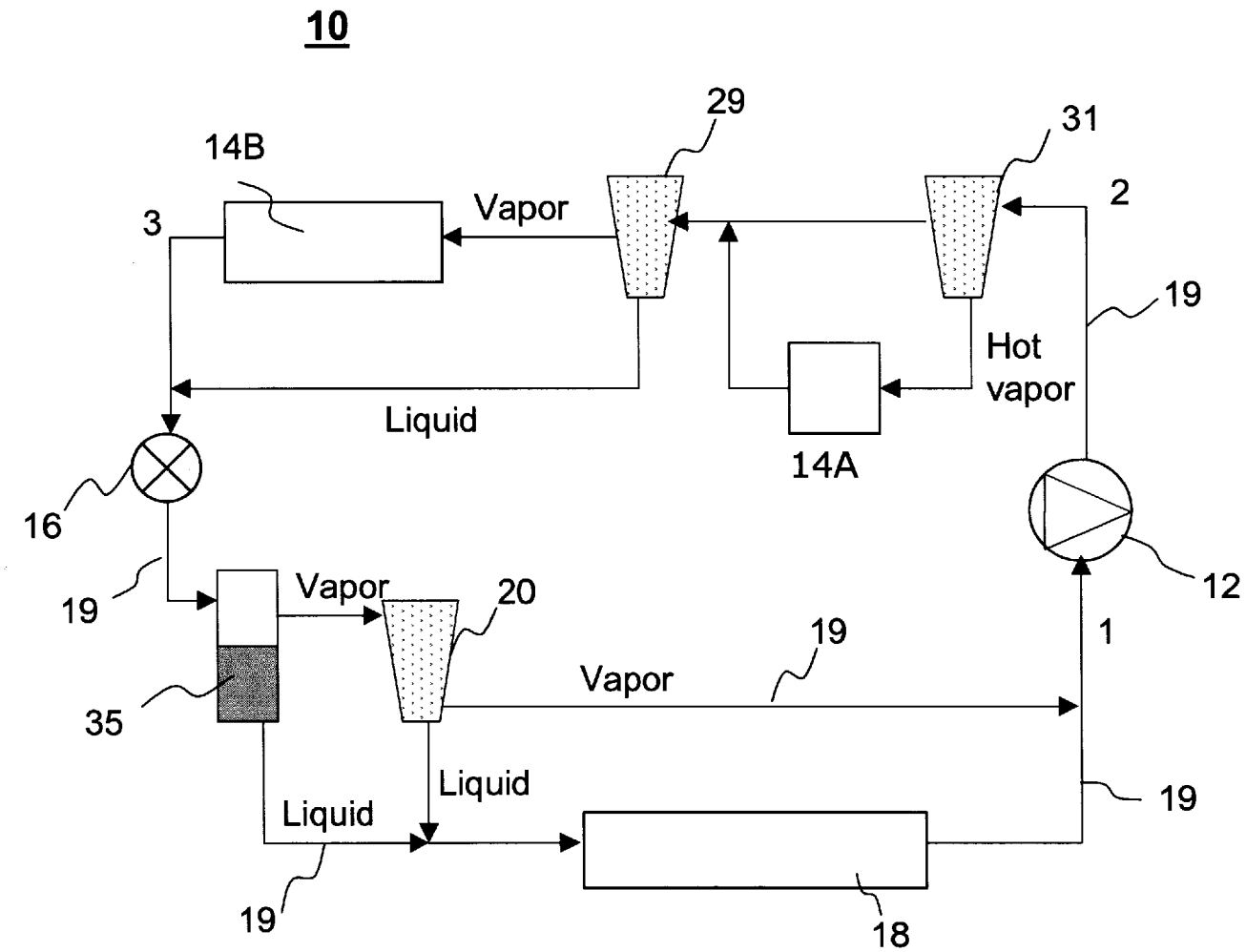
FIG. 9 is a block diagram of another embodiment of a refrigeration system in accordance with the present invention which utilizes a liquid/vapor separator and/or a third vortex tube.

Referring to FIG. 9, another embodiment of the present invention is illustrated. In this embodiment, a liquid/vapor separator 35 may be utilized before a refrigerant enters the vortex tube 20. Liquid/vapor separators are known in other art areas. The liquid/vapor separator 35 ensures that only compressed vapor enters the vortex tube 20. Liquid from the liquid/vapor separator 35 is combined with the liquid that is output by vortex tube 20 and enters the evaporator 18. Any refrigerant vapor that is still present bypasses the evaporator and is directed to the compressor 12.

Also illustrated in FIG. 9 is another variation in which a third vortex tube 31 is inserted in a refrigeration system before condenser 14A. Vortex tube 31 separates the superheated refrigerant into a hot vapor component and a cool vapor component. The hot vapor from vortex tube 31 is directed to condenser 14A. The output of condenser 14A is combined with the cool vapor output from vortex tube 31. The liquid refrigerant from vortex tube 29 bypasses condenser 14B. The liquid refrigerant output from condenser 14B is mixed with the liquid refrigerant output from vortex tube 29.

The variations illustrated in FIG. 9 (i.e., a liquid/vapor separator and a third vortex tube proximate the condenser) may be used together or independently of each other.

Figure 10A:
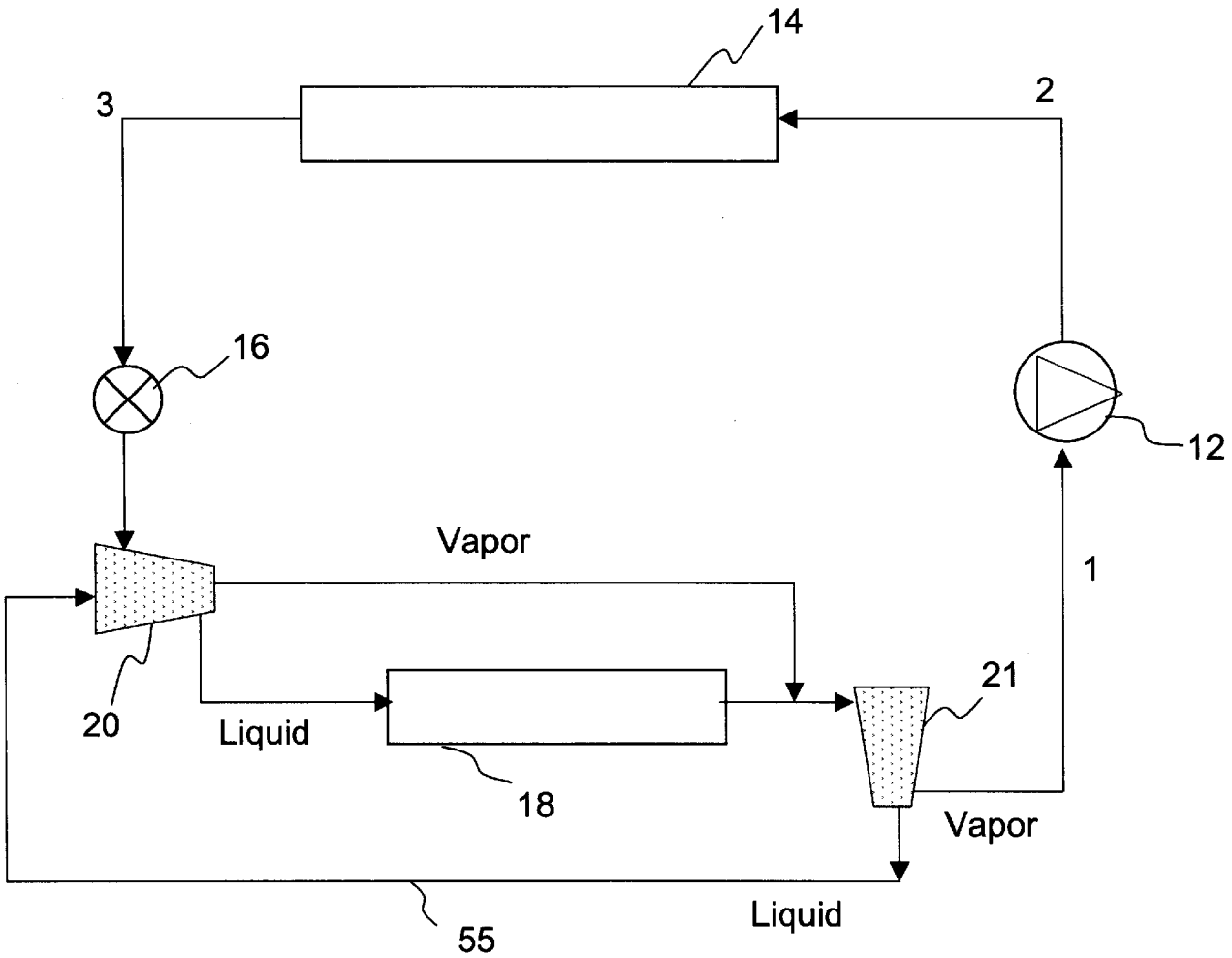
FIG. 10A is a block diagram of another embodiment of a refrigeration system in accordance with the present invention which utilizes two vortex tubes, one before the evaporator and one after the evaporator.

Referring now to FIG. 10A, another embodiment of the present invention is illustrated. This refrigeration system includes the compressor 12, the condenser 14, the expansion device 16, a first vortex tube 20, the evaporator 18, and a second vortex tube 21. The vapor refrigerant that is separated out by first vortex tube 20 is combined with the refrigerant that exits evaporator 18 and is input into second vortex tube 21.

Figure 10B:
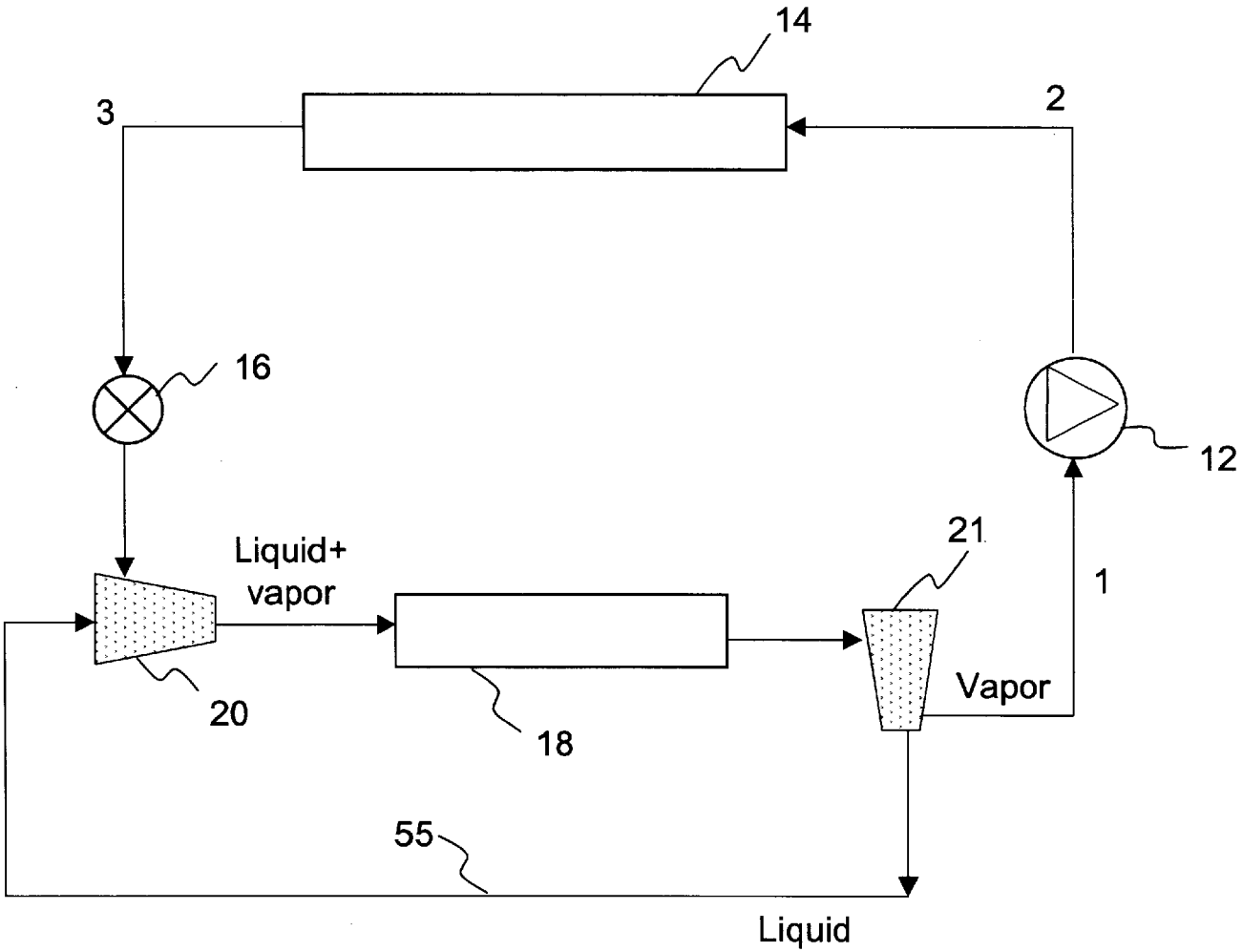
FIG. 10B is a variation of the embodiment illustrated in FIG. 10A in which the liquid and vapor components from the first vortex tube is directed to the evaporator.
Figure 10C:
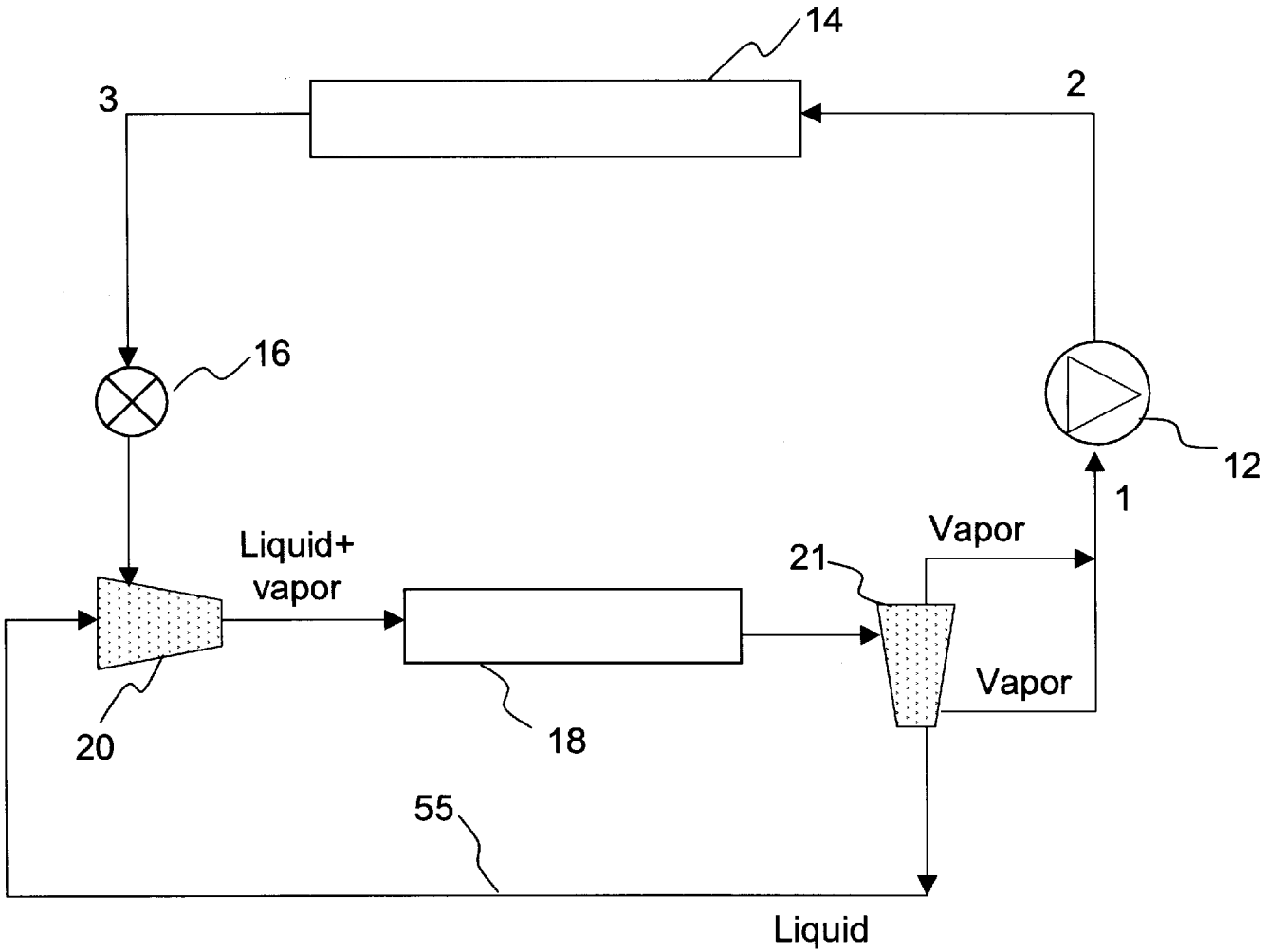
FIG. 10C is a variation of the embodiment illustrated in FIG. 10B in which the central outlet is connected to the inlet of the compressor.

A variation of the refrigeration system of FIG. 10A is shown in FIG. 10B in which the vapor refrigerant from the first vortex tube 20 is directed to the inlet of evaporator 18.

The first vortex tube 21 has two inlets; a tangential inlet and a central inlet that communicates wit the vacuum that is created in the central core of the vortex tube. The refrigerant that enters from the tangential inlet creates the vortex motion which eventually creates a vacuum inside the vortex tube.

In the embodiments illustrated in FIGS. 10A and 10B, the refrigerant, or component thereof that is separated out by the first vortex tube 20 is directed to the input of the evaporator 18. In the evaporator 18, the refrigerant absorbs heat from the surroundings.

The second vortex tube 21 only utilizes a single tangential inlet, i.e., the central inlet is effectively closed off. The second vortex tube 21 also separates the refrigerant into a liquid component and a vapor component. The vapor component from vortex tube 21 is directed to the compressor 12. The liquid refrigerant from second vortex tube 21 is combined with the refrigerant that exits the expansion device 16 via conduit 55. The liquid refrigerant that exits second vortex tube 21 will have sufficient velocity or pressure to be directed back to the inlet of the first vortex tube 20. This can be accomplished by using a two-inlet vortex tube for the first vortex tube 20. A vacuum is created inside the first vortex tube as the vapor refrigerant is converted to the liquid refrigerant and this vacuum communicates with a first central inlet of the first vortex tube. Note that the volume of the refrigerant decreases by a factor of 10 to 100, depending on the type of refrigerants, as phase change occurs from vapor to liquid. Hence, the vacuum inside the first vortex tube draws the liquid refrigerant exiting the second vortex tube without an additional pump. In other words, the first vortex tube 20 acts as a pump.

In the embodiments illustrated in FIGS. 10A and 10B, an increase in the heat absorption is achieved as the liquid passes through evaporator 18; this results in an increase in efficiency of the refrigeration cycle. Second vortex tube 21 also ensures that only vapor refrigerant is returned to compressor 12; this also improves the efficiency of the refrigeration cycle.

Furthermore, the volume of the vapor refrigerant entering the compressor is significantly reduced (by 20%–30% when compared with a refrigeration system that does not use vortex tubes), thus decreasing the compressor work and increasing the efficiency of the refrigeration cycle. Although the same volume of refrigerant is used in the present invention, approximately 30%–40% is being recycled around the evaporator while approximately 70%–80% is fed back to the compressor. Note though that 100% of the refrigerant passes through the evaporator 18.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

We claim:

1. A refrigeration system having a compressor, a condenser, an expansion device, and an evaporator arranged in succession and connected via conduit in a closed loop in order to circulate refrigerant through the closed loop, the improvement comprising:

a first vortex tube placed in the closed loop after the expansion device and before the evaporator for converting at least a portion of the refrigerant vapor exiting the expansion device into liquid; and a second vortex tube placed in the closed loop after the evaporator and before the compressor for converting at least a portion of the refrigerant exiting the evaporator into vapor ensuring that only vapor refrigerant reaches the compressor.

2. The refrigeration system of claim 1 wherein the first vortex tube is placed immediately before the inlet of the evaporator.

3. The refrigeration system of claim 1 wherein the second vortex tube is placed immediately after the outlet of the evaporator.

4. The refrigeration system of claim 1, further comprising a conduit that connects an outlet of the first vortex tube to the inlet of the second vortex tube for allowing vapor refrigerant to bypass the evaporator.

5. The refrigeration system of claim 4, further comprising a conduit that connects an outlet of the second vortex tube to the inlet of the first vortex tube for allowing liquid refrigerant separated by the second vortex tube to be separated further by the first vortex tube.

6. The refrigeration system of claim 1, further comprising a conduit that connects an outlet of the second vortex tube to the inlet of the first vortex tube for allowing liquid refrigerant separated by the second vortex tube to be separated further by the first vortex tube.

7. A refrigeration system for actively changing the state of a refrigerant in order to provide cooling or heating, said refrigeration system comprising:

a compressor for compressing the refrigerant, said compressor having an inlet for introducing low-pressure vapor refrigerant and an outlet for discharging compressed high-pressure refrigerant;

a condenser connected to said compressor via a first conduit, said conduit being capable of directing refrigerant through its interior;

an expansion device connected to said condenser via a second conduit;

a first vortex tube having an inlet that connects to said expansion device via a third conduit, said first vortex tube also having a low-temperature outlet and a high-temperature outlet;

an evaporator connected to the low-temperature outlet of said first vortex tube via a fourth conduit;

a second vortex tube having an inlet that connects to the outlet of said evaporator via a fifth conduit, said inlet of the second vortex tube also connected to said high-temperature outlet of the first vortex tube, via a sixth conduit, and the second vortex tube having a low-temperature outlet connected to said inlet of said first vortex tube via a seventh conduit, and the second vortex tube having a high-temperature outlet connected to said compressor via an eighth conduit thereby forming a closed loop system for circulating the refrigerant through said elements and conduits.

8. The refrigeration system of claim 7, wherein said expansion device is a capillary tube for adjusting the pressure of the refrigerant that passes therethrough.

9. The refrigeration system of claim 7, wherein said expansion device is an expansion valve for adjusting the pressure of the refrigerant that passes therethrough.

10. The refrigeration system of claim 7, wherein said compressor comprises an electric motor.

11. A refrigeration system for actively changing the state of a refrigerant in order to provide cooling or heating, said refrigeration system comprising:

a compressor for compressing the refrigerant, said compressor having an inlet for introducing low-pressure refrigerant and an outlet for discharging compressed high-pressure vapor refrigerant;

a condenser for accepting the high-pressure vapor refrigerant output from the compressor, the condenser cooling the refrigerant vapor component until a majority is converted into a liquid;

an expansion device connected to the condenser for accepting the refrigerant from the condenser, the expansion device throttling the refrigerant;

a first vortex tube for accepting the refrigerant from the expansion device, the first vortex tube separating the refrigerant into a vapor component and a liquid component;

an evaporator for accepting the liquid component from the first vortex tube, said evaporator facilitating the absorption of heat by the refrigerant as it flows therethrough;

a second vortex tube for accepting the refrigerant output from the evaporator and the vapor component output from the first vortex tube, the second vortex tube separating the refrigerant into a vapor component and a liquid component, said liquid component of the second vortex tube being directed back to the inlet of said first vortex tube and said vapor component of the second vortex tube being directed back to the inlet of the compressor.

12. A refrigeration system for actively changing the state of a refrigerant in order to provide cooling or heating, said refrigeration system comprising:

a compressor for compressing the refrigerant, said compressor having an inlet for introducing low-pressure refrigerant and an outlet for discharging compressed high-pressure vapor refrigerant;

a condenser for accepting the high-pressure vapor refrigerant output from the compressor, the condenser cooling the refrigerant vapor component until a majority is converted into a liquid;

an expansion device connected to the condenser for accepting the refrigerant from the condenser, the expansion device throttling the refrigerant;

a first vortex tube having a tangential inlet for accepting the refrigerant from the expansion device, a central inlet that communicates with a vacuum created in the vortex tube and a single outlet;

an evaporator for accepting the refrigerant that is output from the first vortex tube, said evaporator facilitating the absorption of heat by the refrigerant as it flows therethrough;

a second vortex tube for accepting the refrigerant output from the evaporator, the second vortex tube separating the refrigerant into a vapor component and a liquid component, said liquid component of the second vortex tube being directed back to the central inlet of said first vortex tube and said vapor component of the second vortex tube being directed to the inlet of the compressor.

* * * * *